United States Patent [19]

Huebsch et al.

[11] 4,407,329

[45] Oct. 4, 1983

[54] MAGNETICALLY OPERATED FAIL-SAFE CUTOFF VALVE WITH PRESSURE EQUALIZING MEANS

[76] Inventors: Donald L. Huebsch, 3716 Prestwick Dr., Los Angeles, Calif. 90027; Louis B. Paulos, 9616 Yolanda Ave., Northridge, Calif. 91324

[21] Appl. No.: 303,355

[22] Filed: Sep. 18, 1981

Related U.S. Application Data

[63] Continuation-in-part of Ser. No. 140,188, Apr. 14, 1980, abandoned.

[51] Int. Cl.[3] ..... E21B 43/12

[52] U.S. Cl. ..... 137/629; 166/65 M; 166/332; 251/139

[58] Field of Search ..... 137/629; 166/65 R, 65 M, 166/316, 332; 251/139

[56] References Cited

U.S. PATENT DOCUMENTS

| | | | |
|---|---|---|---|
| 3,249,124 | 5/1966 | Berryman | 137/629 |
| 3,314,448 | 4/1967 | Wolf | 137/629 X |
| 3,583,442 | 6/1971 | Dollison | 137/629 X |
| 3,731,742 | 5/1973 | Sizer | 166/65 M X |
| 4,002,202 | 1/1977 | Huebsch | 251/139 X |
| 4,161,215 | 7/1979 | Bourne | 166/65 M |

*Primary Examiner*—Robert G. Nilson

*Attorney, Agent, or Firm*—Sellers and Brace

[57] ABSTRACT

A magnetically operated fail-safe cutoff valve of general application and particularly suitable for down hole fluid well applications is provided having a simple highly reliable valve for equalizing the pressure across the main cutoff valve while closed thereby permitting the same to be opened. All operating components can be either removably installed internally of a tubing string or as a portion of the string itself. In either case, typical wire line operations can be conducted through and past the lower end of the cutoff valve since the flow path of each of the illustrative embodiments provides an unobstructed linear flow path therethrough when the valve is open. The pressure equalizing valve includes multiple flow passages and is controlled by a shrouded annular armature operable independently of a tubular armature controlling the main cutoff valve. The two armatures may be located in either common or separate flux circuits.

66 Claims, 11 Drawing Figures

FIG. 4a.
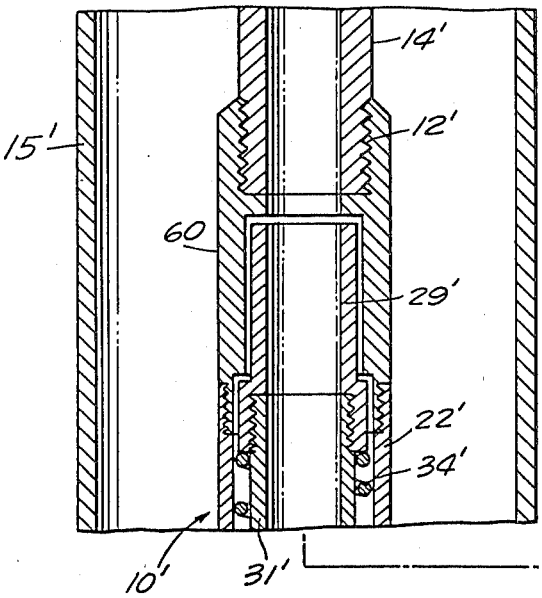
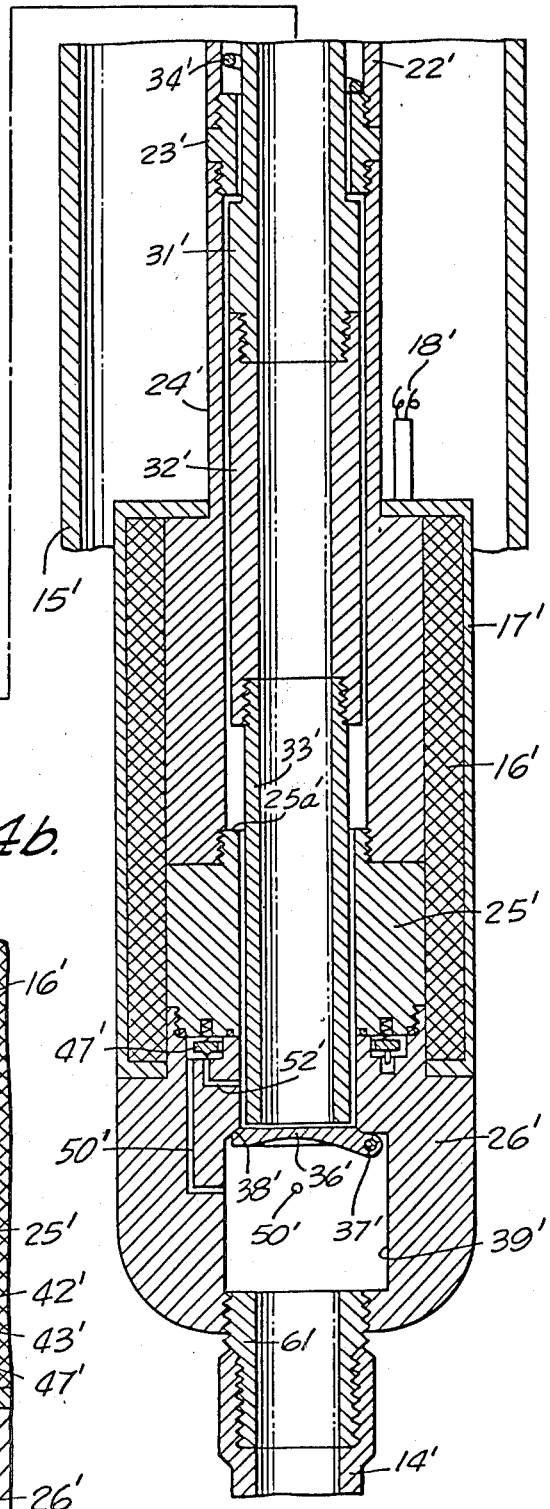
FIG. 4b.
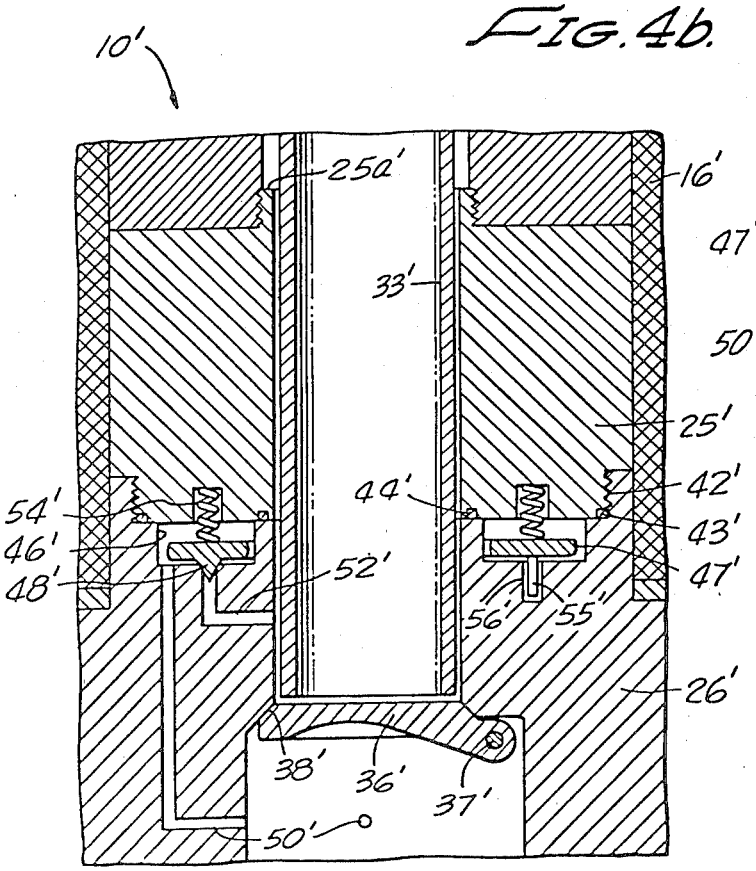
FIG. 5.
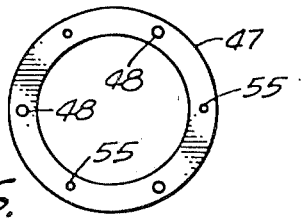
FIG. 6.

MAGNETICALLY OPERATED FAIL-SAFE CUTOFF VALVE WITH PRESSURE EQUALIZING MEANS

This application is a continuation in part of our copending application for U.S. Letters Patent Ser. No. 140,188 filed Apr. 14, 1980, now abandoned, and having the same title as this application.

BACKGROUND OF THE INVENTION

Down hole safety cutoff valves necessitate provision for re-opening the valve after a shutdown operation utilizing suitable means for equalizing the pressure across the closed cutoff valve. Recently, valves have been developed employing magnetic means for opening the cutoff valve, as for example, the safety cutoff valves disclosed in our U.S. Pat. No. Re. 30,110 granted Oct. 9, 1979 and U.S. Pat. No. 4,161,215 granted to Henry A. Bourne Jr. et al on July 17, 1979. The magnetic cutoff valve shown in our patent relies upon surface equipment to build up pressure above the valve to a value nearly equal to that below the valve whereupon the solenoid can be employed to re-open the valve and maintain it open. Additional surface equipment and time is involved. Bourne et al avoids the need for such surface equipment by utilizing a magnetically operated pressure equalizing facility within their safety cutoff valve. However, certain of these components are located directly in the flow path thereby precluding wire line operations below the valve, impeding the flow, and subjecting important components to fouling and other hazards.

Other proposals have been made for opening magnetically controlled shut off valves in pressurized flow lines of which the following are typical; Boyle U.S. Pat. No. 1,807,191; Hart U.S. Pat. No. 2,693,929; Kramer U.S. Pat. No. 2,969,088; Bullard U.S. Pat. No. 3,100,103; Van Domelen U.S. Pat. No. 3,125,321; Okane U.S. Pat. No. 3,381,932; Keller U.S. Pat. No. 3,405,906; and Sangl U.S. Pat. No. 3,762,683. No one of these constructions with the possible exception of Hart could be installed in a well because the solenoid coil and the armature actuated thereby lie generally normal to the flow path thereby precluding their use in well casings and tubing strings which are subject to severe and rigid cross sectional limitations. Hart is manifestly unsuitable for fluid well applications.

SUMMARY OF THE INVENTION

The foregoing and other shortcomings of prior proposals are circumvented by this invention which provides a simple highly-efficient highly-reliable solenoid operated safety cutoff valve featuring a unique pressure equalizing facility having its own armature and responsive to solenoid coil means serving to operate the main or safety cutoff valve. In accordance with the teachings of our U.S. Pat. No. Re. 30,110, all components except the solenoid coil may be detachably installed by wire line in an existing tubing string or the entire valve subassembly may form a flow unit of the tubing string itself. Likewise, the features of our new cutoff valve assembly can be operated by either single or tandem solenoid operators, the latter type being disclosed in our copending application, Ser. No. 866,335, filed Jan. 3, 1978, entitled Tandem Solenoid Controlled Safety Cutoff Valve for A Fluid Well, now U.S. Pat. No. 4,191,248. It will therefore be understood that the principles of this invention can be utilized with equal efficacy with either single or tandem solenoid operators or other types of operators.

Typically, the pressure equalizing facility comprises an annular armature ring embracing the flow passage at one end of either a common or separate pole pieces for both the main valve armature and the equalizing armature. Preferably, the pressure equalizing armature operates a plurality of self-centering self-aligning valves each controlling a separate pressure equalizing flow passage arranged in parallel with one another and cooperating to speed up the pressure equalizing operation as well as to safeguard against malfunctioning if one passage should become fouled. The pressure equalizing armature has an extensive pole face area to develop maximum pull to counteract the well pressure holding the pressure equalizing valves closed. Well pressure is also utilized to provide fail safe closure of the pressure equalizing valve or valves.

Another feature resides in the fact that the pressure equalizing sub-assembly involves a minimum number of components mounted at one end of the main assembly and held assembled thereto by a threaded joint. Accordingly, the pressure equalizing sub-assembly can be detached as a unit for servicing without need for disturbing any other component.

Accordingly, it is a primary object of this invention to provide an improved magnetically operated fail-safe cutoff valve utilizing a unique facility to equalize the pressure differential to allow the cutoff valve to be opened without the aid of surface pressure producing equipment.

Another object of the invention is the provision of a safety cutoff valve providing an unobstructed linear flow path while open and provided with a magnetically operated pressure equalizing valve for opening the cutoff valve.

Another object of the invention is the provision of a magnetically controlled safety cutoff valve assembly installable in a tubing string having separately operable armatures one of which controls a main cutoff valve and the other the pressure equalizing valve facility and provided with either a common pole piece or separate pole pieces.

Another object of the invention is the provision of a magnetically controlled safety cutoff valve so constructed that unimpeded wire line operations can be conducted through and below the cutoff valve.

Another object of the invention is the provision of a safety cutoff valve selectively operable by its own on-board pressure equalizing valve or by surface or remotely controlled pressure equalizing means in the event of malfunctioning of the on-board equalizing valve.

Another object of the invention is the provision of a safety cutoff valve incorporating a pressure equalizing valve facility each operable by solenoid means utilizing a minimum of power to hold both the safety valve open and the pressure equalizing valve facility open.

Another object of the invention is the provision of a magnetically operated self-centering self-aligning pressure equalizing valve for equalizing the pressure across a closed cutoff valve.

Another object of the invention is the provision of a magnetically operated safety cuttoff valve selectively operable to open position by pressure equalization from surface facilities or by a built-in pressure equalizing valve.

Another object of the invention is the provision of a magnetically controlled safety cutoff valve having a pressure equalizing sub-assembly constructed for detachment and servicing independently of other components of the cutoff valve assembly.

Another object of the invention is the provision of a magnetically controlled safety cutoff valve having a pressure equalizing facility all moving parts of which are floatingly supported free of fluid seals.

Another object of the invention is the provision of a solenoid operated pressure equalizing valve facility for a safety cutoff valve having a plurality of equalizing flow passages in parallel to avoid malfunctioning due to fouling of one or more thereof.

Another object of the invention is the provision of a magnetically controlled safety cutoff valve having a pressure equalizing facility utilizing an armature separated by a minimum air gap from its cooperating pole piece.

Another object of the invention is the provision of a magnetically controlled safety cutoff valve having separate armatures for the main valve and for the pressure equalizing facility and the latter of which armatures is separated from its pole piece by a small air gap as compared with the air gap between the pole piece for the cutoff valve operating armature.

These and other more specific objects will appear upon reading the following specification and claims and upon considering in connection therewith the attached drawing to which they relate.

Referring now to the drawing in which a preferred embodiment of the invention is illustrated:

Figure 1:
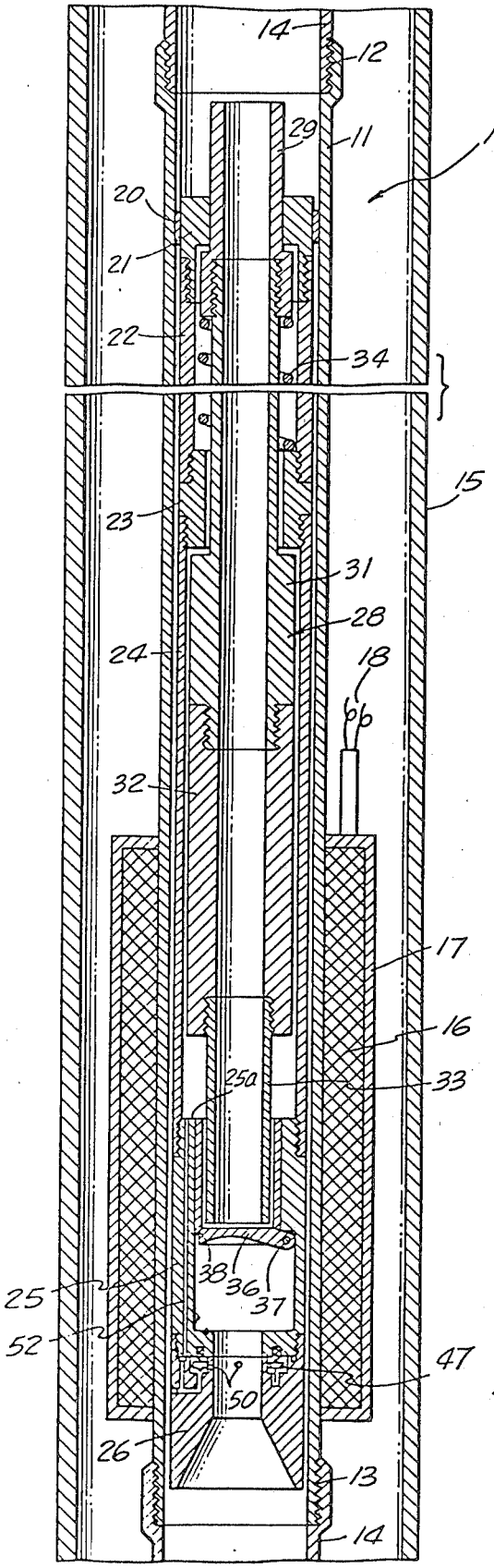
FIG. 1 is a vertical cross sectional view through a first illustrative embodiment of the invention showing a wire line retrievable safety cutoff valve closed and with the solenoid energized to hold the pressure equalizing valve open.
Figure 2:
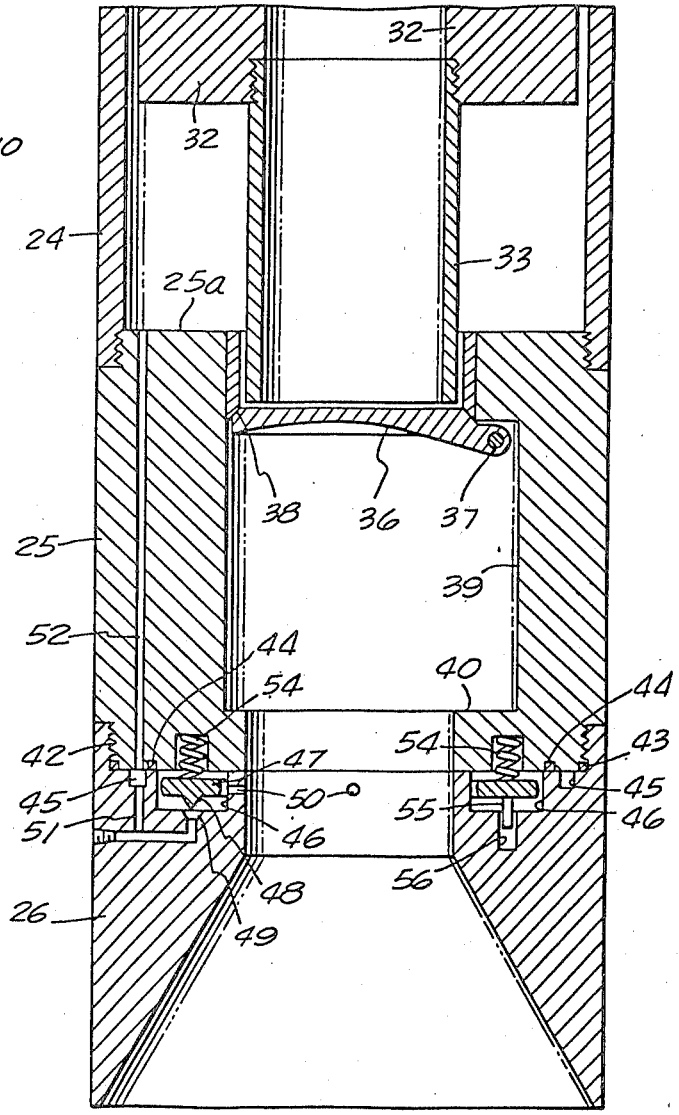
FIG. 2 is a fragmentary view on an enlarged scale through the lower end of the cutoff valve but omitting its tubular housing and the solenoid coil.
Figure 3:
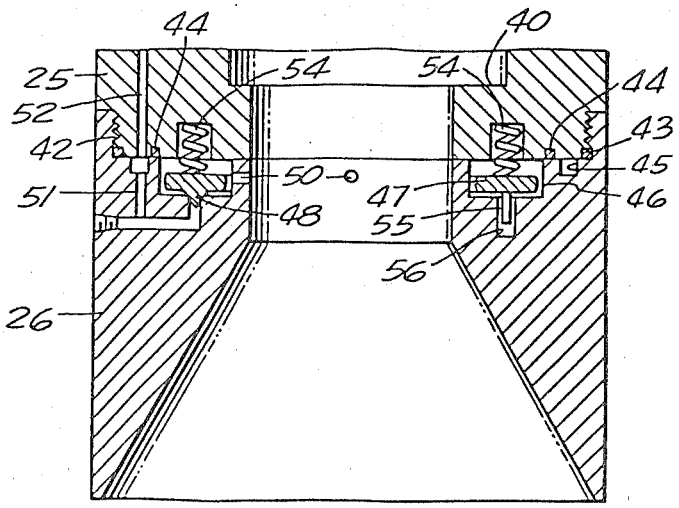
FIG. 3 is a view similar to FIG. 2 but showing only the lowermost end of the cutoff valve with the pressure equalizing valve in closed position.
Figure 7:
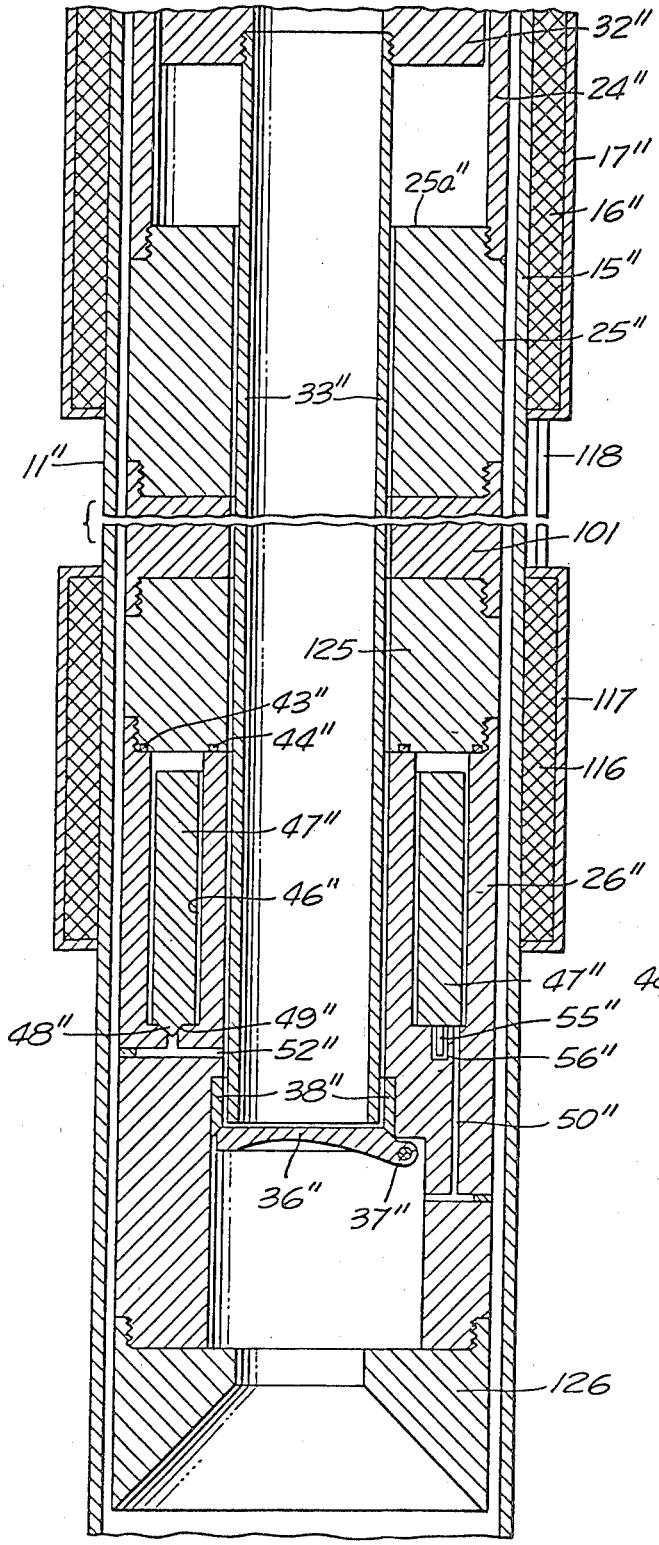
Figure 8:
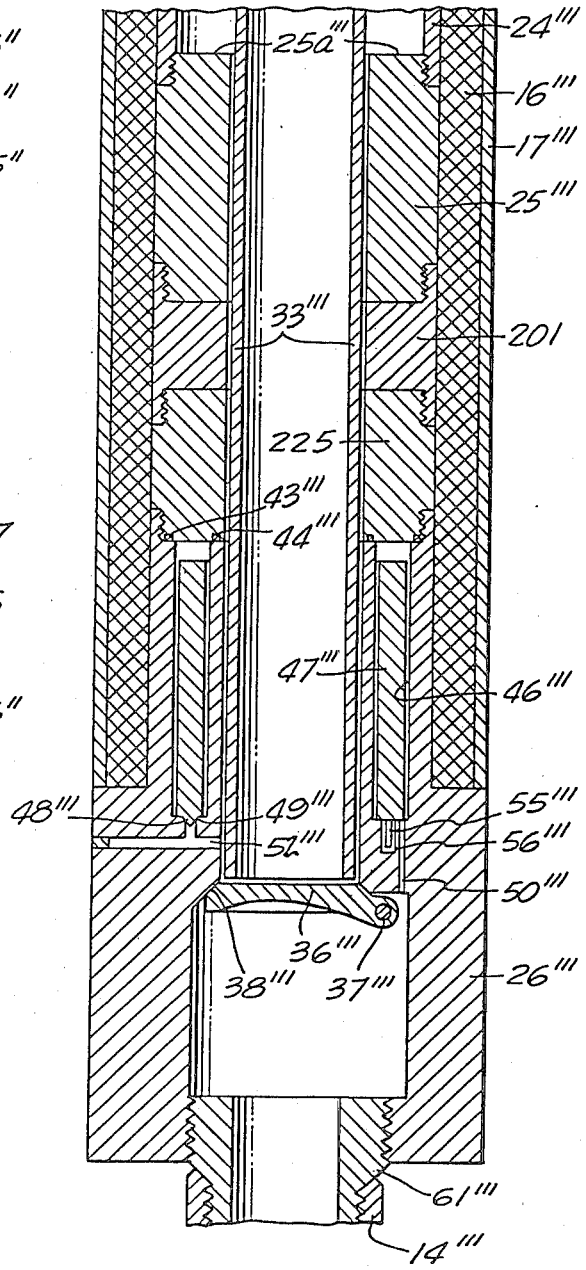
Figure 9:
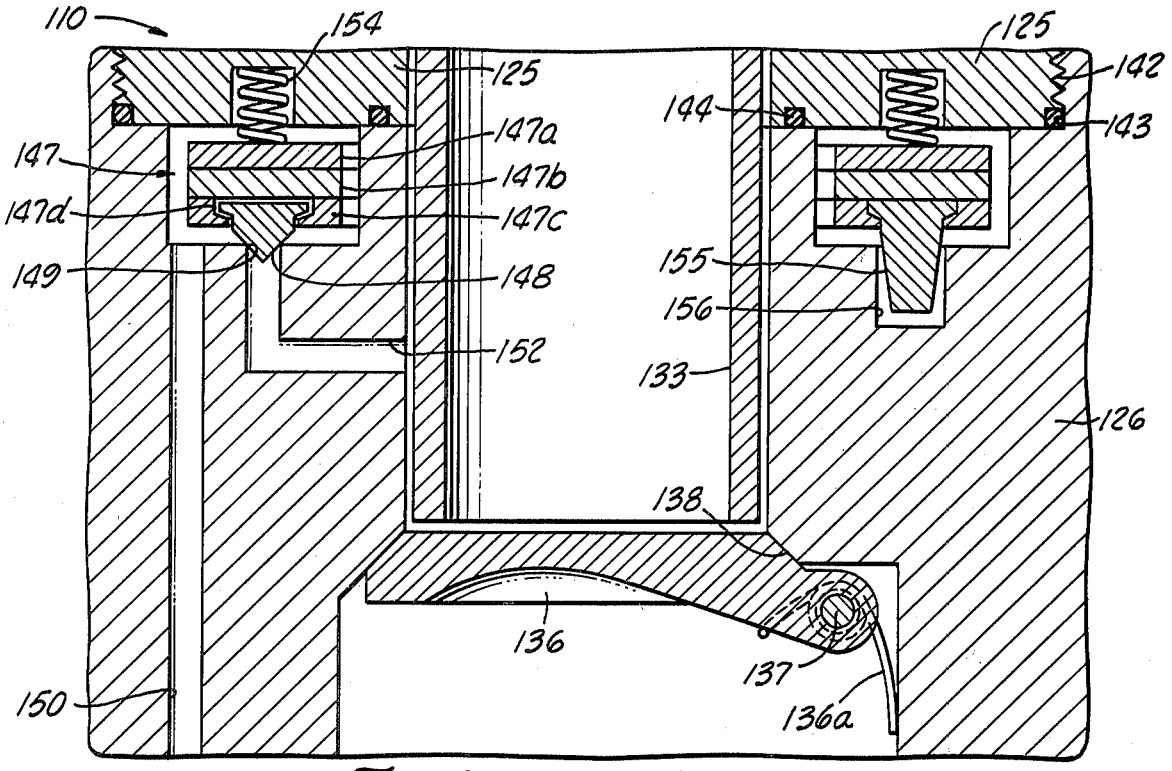
Figure 10:
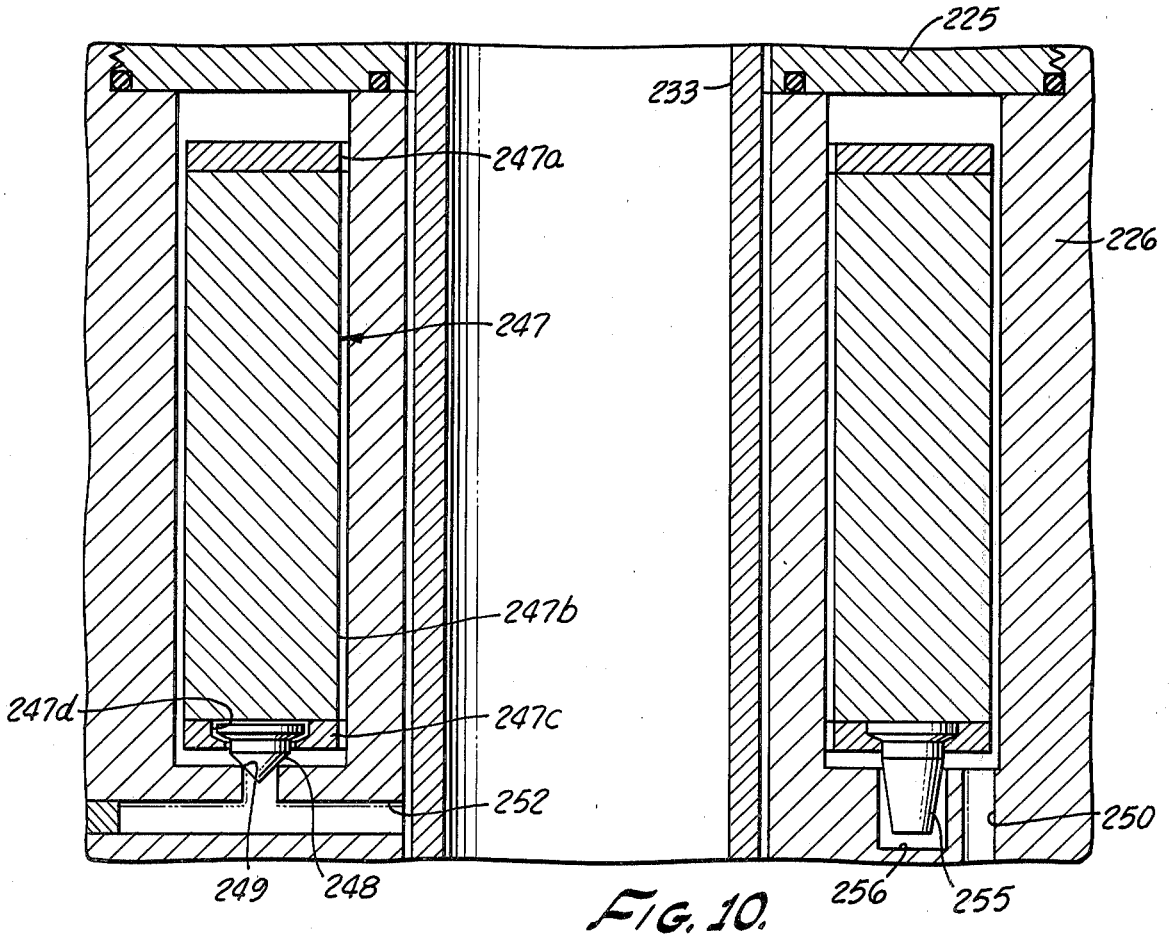

FIGS. 4*a* and 4*b* are cross sectional views through a second illustrative embodiment of the invention showing a tubing retrievable cutoff valve assembly wherein the cutoff valve assembly interconnects adjacent sections of and forms a flow unit of a tubing string and showing the cutoff valve closed and the solenoid energized to hold the pressure equalizing valve open;

FIG. 5 is a fragmentary cross sectional view of an enlarged scale through the lower end portion of FIG. 4*b* and showing both the cutoff valve and the pressure equalizing valve closed;

FIG. 6 is a plan view from the underside of the pressure equalizing armature for either embodiment;

FIG. 7 is a cross sectional view of the lower end of a variant of the embodiment shown in FIGS. 1–3 utilizing separate pole pieces and solenoids for the two armatures;

FIG. 8 is a cross sectional view of the lower end of a variant of the embodiment shown in FIGS. 4*a* to 6 also utilizing separate pole pieces for the two armatures; and FIGS. 9 and 10 are fragmentary cross sectional views on an enlarged scale showing details of alternate embodiments of the pressure equalizing valve and the associated armature.

Referring initially to FIGS. 1 to 3, there is shown a safety cutoff valve assembly, designated generally 10, having a tubular main housing or landing nipple 11 of non-magnetic material with its threaded ends 12, 13 coupled between the adjacent ends of a tubing string 14. This tubing string extends downwardly through a well casing 15. Embracing landing nipple 11 is a solenoid coil 16 enclosed in a casing of suitable material 17 welded or otherwise secured at its ends to nipple 11. Coil 16 has insulated electrical leads 18 extending to ground level between tubing string 14 and the well casing 15. All other parts of the cutoff valve assembly 10 are mounted interiorly of landing nipple 11 as a unitary assembly.

This unitary assembly is detachably connected to the housing landing nipple 11 solely by a fluid tight seal and coupling 20 of well known construction permitting the subassembly to be installed and detached with conventional wire line tools. The subassembly so supported within the landing nipple includes a collar 21 threaded to the upper end of a coupling 22 secured to a nipple 23. Suspended from the lower end of nipple 23 is a coupling 24 of non-magnetic material coupled at its lower end to a tubular pole piece 25 of magnetic material. Detachably threaded to the lower end of the pole piece is the pressure equalizing facility 26 of non-magnetic material housing therewithin the moving component of the pressure equalizing valve.

Reciprocably supported within the above described non-magnetic annular components 21 through 24 is a tubular armature assembly designated generally 28, including components 29, 31, 32 and 33. All of these components except armature 32 are of non-magnetic material, 32 being magnetic material and preferably including a non-magnetic spacer ring between its lower end and pole piece 25*a* to avoid the effect of residual magnetism. When solenoid coil 16 is not energized, compression spring 34 supports the armature assembly 28 in its elevated or extended position as shown in FIG. 1. The lower end of sleeve 33 is then positioned immediately above the closed flapper-type main or cut-off valve 36 pivotally supported at 37 and urged closed against an annular seat 38 as by a spring 136*a* (FIG. 9). It will be noted that armature 32 is then spaced well above the upper end 25*a* of pole piece 25. As is best shown in FIG. 2, the chamber in which valve 36 is housed is cut away along the right hand side as indicated at 39 to accommodate the cutoff valve and to allow sleeve 33 to move downwardly therepast to a position closely adjacent the shoulder 40 near the lower end of pole piece 25. The non-magnetic sleeve 33 then shields valve 36 and seat 38 from contaminants and contact with the fluid flow taking place past the open valve.

The pressure equalizing valve subassembly 26 comprises a non-magnetic ring which is detachably coupled to pole piece 25 by threads 42 and is sealed against the end thereof by O-rings 43, 44. The adjacent end face of the subassembly 26 is provided with a pair of annular channels 45, 46, channel 45 serving as a fluid distribution channel and channel 46 serving to house and conceal an armature ring 47 of magnetic material. Projecting downwardly from the underside of armature 47 are a plurality of conical valves 48 which seat against valve seats 49. A plurality of fluid passages 50 extend between channel 46 and the main fluid stream downstream from cutoff valve 36. If valves 48 are unseated fluid escapes from channel 46 through a plurality of inlet passages 51 into the annular fluid distributing channel 45 which communicates with a plurality of outlet passages 52 extending the full length of pole piece 25 and discharge into the tubing string on the downstream side of the cutoff valve 36. Typically there are three passages 50 and these preferably have a cross section smaller than passages 51, 52 so that foreign matter which may be present in the well fluid can pass more readily therethrough thereby minimizing the likelihood of particulates accumulating in channel 46. Likewise it is preferable that valves 48 open sufficiently to freely pass particles permitted to enter through passages 50 which are then readily discharged through passages 51, 52.

When the solenoid is not energized compression springs 54, assisted by the down hole pressure acting on the cross sectional area of valve seats 49, hold armature 47 extended and valves 48 seated over the inlets to passages 51. To safeguard against valves 48 becoming misaligned with their seats 49, armature 47 is equipped with a plurality of aligning pins 55 projecting downwardly into cooperating wells 56 opening into the bottom of channel 46. As is best shown in FIG. 6, valves 48 are distributed about the armature ring between alignment pins 55.

Referring now to FIGS. 4*a*, 4*b* and 5, there is shown a second preferred embodiment of the invention safety cutoff valve wherein the same or similar components as those described above in connection with FIGS. 1, 2 and 3 are designated by the same reference characters distinguished by a prime. The two construction differ in only minor respects from one another, the primary difference being that the first embodiment has all components except the solenoid detachably installed interiorly of the landing nipple 11 forming a part of the fluid flow passage of the tubing string 14, 14 whereas in the second embodiment the entire cutoff assembly forms part of the tubing string and is serviced by withdrawal of the tubing string.

Referring to FIGS. 4*a* and 4*b*, it will be noted that the upper end of the cutoff valve assembly 10' is connected to the overlying section of tubing string 14' by a coupling 60 and its lower end is connected to the upper end of the underlying tubing string section 14' by a nipple 61. Also the pole piece 25' interposed between the cutoff valve armature 32' and the pressure equalizing valve armature 47' differs somewhat in structural details but is functionally the full equivalent of the pole piece 25 described above.

Referring now to FIGS. 7 and 8, there are shown variants of the respective first and second embodiments and differing therefrom in principle and in structure only in minor respects. These differences are confined essentially to the lower end of the assembly and, accordingly, only these lower portions are illustrated. FIG. 7 shows a cutoff valve assembly installable in tubing string by wire line in the manner described in detail in connection with FIGS. 1 to 3, and FIG. 8 shows a cutoff valve assembly as constructed for installation directly in the tubing string in the manner disclosed in detail in FIGS. 4*a* through 5.

Principal structure difference between FIGS. 7 and 8 and the first described embodiments is the provision of separate pole pieces for each of the armatures separated from one another by a ring of non-magnetic material. The armature for the pressure equalizing valve is also very substantially longer to increase the effective solenoid pull, and biased closed by gravity. Another difference resides in the fact that the solenoid coil for FIG. 7 is made in two sections each embracing a respective one of the armatures whereas in FIG. 8 a single solenoid coil is utilized for both armatures.

Referring now to FIG. 7, it will be understood that the same or similar components to those described in FIG. 1 to 3 are designated by the same reference characters distinguished by a double prime. The electric coil embracing the landing nipple 11'' is made in two sections, the upper section 16'' embracing the armature 32'' being operable to open the cutoff valve 36'' and the second coil section 116 embracing the ring armature 47'' located in the annular chamber 46'' and provided at its lower end with a plurality of conical pressure equalizing valves 48''. The lower end of the main armature 32'' comes to rest against the upper end 25*a*'' of the magnetic pole piece 25''. This pole piece is coupled to pole piece 125 for armature 47'' by a non-magnetic ring 101.

The pressure equalizing valve subassembly includes the non-magnetic rings 26'' and 126. Ring 26'' is provided with a plurality of passages 50'' and 52'' cooperating to bleed equalizing fluid from the inlet to outlet sides of cutoff valve 36''.

Referring now to FIG. 8, it will be understood that the cutoff valve assembly there shown has a housing 24''' cooperating with other tubular components not shown interconnecting sections of the tubing string itself 14'''. Accordingly, this cutoff valve is retrievable only by withdrawing the tubing string itself. The same or similar components to those described in FIGS. 4*a* and 6 are identified by the same reference characters but distinguished therefrom by the addition of a triple prime. As in FIG. 7, pole piece 25''' is connected to the pressure equalizing valve pole piece 225 by a non-magnetic ring 201. The lower end of the pressure equalizing valve armature 47''' is provided with a plurality of conical valves 48''' seating against seats 49''' of the outlet passage 52'''. When the armature 47''' is retracted the equalizing valves 48''' are open allowing higher pressure fluid to exhaust through passages 52''' into the lower pressure chamber overlying the cutoff valve 36'''.

FIGS. 9 and 10 show alternate and preferred constructional features of the pressure equalizing valve and the associated armature the details of which are not readily ilustrated in FIGS. 1 to 8. FIG. 9 shows details of the embodiment of the equalizing valve and armature of FIGS. 1 to 6 whereas FIG. 10 illustrates the corresponding details as respects FIGS. 7 and 8. More specifically, FIG. 9 is based on FIG. 5 whereas FIG. 10 shows further details of the pressure equalizing valve and armature ring of FIGS. 7 and 8.

Referring to FIG. 9, the parts there shown are designated by the same characters employed in describing FIG. 5 but are distinguished therefrom by adding the digit 1 before each character and omitting the prime after the last digit.

The only component which differs from that shown and described above in connection with FIGS. 1 to 6 is the pressure equalizing armature and valve assembly 147 This subassembly includes an air gap simulating ring 147*a* of non-magnetic material suitably secured to a ring of magnetic material 147*b*. The latter is preferably secured to a non-magnetic ring 147*c* machined to loosely seat at least one and preferably three separate self-aligning, self-centering non-magnetic valves 148 and to firmly grip a like number of aligning pins 155 each projecting downwardly into a well 156. The flanged conical valves 148 have limited freedom to move in all directions in the countersunk bores 147*d* having a loose fit with the flanged upper end of the conical valves 148.

FIG. 10 employs the same reference characters as FIGS. 7 and 8 except that the numeral 2 has been added in front of each and the primes following the last digit have been omitted. The only structural changes are restricted to the armature 247 controlling the operation of the pressure equalizing valves 248.

An air gap simulating shim 247*a* of non-magnetic material is suitably secured to the top of the magnetic ring 247*b* and the flanged conical non-magnetic equalizing valves 248 are held loosely and floatingly captive in countersunk bores 247*d* through the ring of non-magnetic material 247*c*. The valve aligning pins 255 are mounted immovably in respective counterbores of ring 247*c* and cooperate with wells 256 in maintaining each of the three valves 248 generally aligned with a respective one of the seats 249.

It will be apparent from the foregoing description of FIGS. 9 and 10 that the pressure equalizing valves and armatures of these figures are identical in purpose and function and differ only in minor details structurally. The function of the air gap simulating rings 147*a* and 247*a* is to safeguard against the possibility that, in the absence of spacer 147*a*, or 247*a* residual megnetism could delay or prevent the separation of the armature from the overlying pole piece 125 or 225 promptly and reliably upon deenergization of the solenoid coil surrounding each of these armature units. The ring 147*c* and 247*c* serve to hold the aligning pins 155 and 255 firmly and immovably assembled to the bottom of the armature and, additionally and importantly, to floatingly support each of the conical valves 148 and 248 thereby allowing each of these valves to move independently of the other and as necessary to assure a bubble tight fit with the seats 149 or 249 at the entrance to the passages 152 and 252 leading to the upper or outlet side of the main cutoff valves 136. The main cutoff valve for FIG. 10 is not shown because located below the bottom of this Figure and therefore out of view.

OPERATION

Since all embodiments are generally similar in construction and function in substantially the same way, a detailed description of one will suffice for all. Let it be assumed that the solenoid coil 16 is deenergized so that the compression spring 34 holds the cutoff valve armature 32 and all tubular components assembled thereto elevated or extended to a position slightly above the closed flapper valve 36. The well pressure below this valve will then be communicated to the annular chamber 46 through the several parallel passages 50 with the result that springs 54 and the well pressure will hold the pressure equalizing armature 47 and the attached valves 48 seated over seats 49 thereby isolating the well pressure from the inlets to passages 52. In accordance with conventional practice, the well head at the top of the tubing string will be equipped with a Christmas tree provided with a tightly closed valve, not shown.

The operator having ascertained that this last mentioned valve is tightly closed proceeds to energize solenoid 16 via leads 18. The flux generated by this solenoid will attract the pressure equalizing armature ring 47 in opposition to spring 54 and the forces generated by the well pressure against valves 48 and seats 49 thereby opening valves 48 but will have negligible effect upon the main valve armature 32 owing to the greater forces generated by the same well pressure against the larger area of cutoff valve 36 and holding this valve firmly seated. Once armature ring 47 has been pulled against the end of pole piece 25, the current flow to the solenoid may be reduced. The unseated equalizing valves 48 allow high pressure fluid to be communicated from beneath the closed flapper valve 36 to the chamber above this valve via passage 50, 46, 51, 45 and 52. Accordingly, the pressure differential across the cutoff valve gradually diminishes to a low value. Thereupon the operator sharply increases the current to solenoid 16 until the flux generated by coil 16 becomes effective to move armature 32 downwardly thereby pivoting cutoff valve 36 counterclockwise to its fully open position. The lower end of the armature 32 will then seat against the upper end 25*a* of the magnetic pole piece 25 with the lower end of its tubular sleeve 33 almost seated against the bottom of the cutoff valve chamber. Valve 36 is then completely shielded from the continuous linear flow path for the fluid upwardly through the tubing string and valve assembly 10.

Once valve 36 is fully open, the current flow through solenoid 16 may again be reduced since a substantially smaller current flow suffices to hold armature 32 retracted against pole face 25*a* and in position to shield both seat 38 and valve 36 via sleeve 33 from fouling or abrasion by gritty or other foreign material in the flow taking place therepast.

Should the power supply to the solenoid fail or should the operator wish to close the cutoff valve he merely discontinues the power supply to the solenoid whereupon spring 34 promptly elevates the armature assembly 28 to its upwardly extended position allowing the torsion spring of the cutoff valve 36 to close the same against seat 38. Likewise armature 47 is extended downwardly by the well pressure and the springs 54 so that valves 48 firmly seat against seats 49. The high pressure fluid below the closed cutoff valve is then transmitted to the annular chamber 46 via passages 50 and supplements springs 54 in maintaining the equalizing valves 48 tightly closed.

If the pressure equalizing facility becomes disabled or fails to function upon demand, the safety cutoff valve may be opened by employing surface equipment well known to persons skilled in this art to pressurize the tubing string to a value approaching or equal to the pressure downstream from valves 10 or 10'. The solenoid coil of the safety cutoff valve is then energized and functions to retract the cutoff valve armature assembly 28 thereby opening cutoff valve 36 or 36' and restoring the well flow to a more propitious time for servicing the non-functioning of the on-board pressure equalizing facility.

The foregoing description of the operation typical of the embodiments shown in FIGS. 1 to 8 there shown as employing a non-laminated armature integral with pressure equalizing valves applies equally to FIGS. 9 and 10 with certain obvious advantages. For example, each of the three valves 148 or 248 is floatingly assembled to the lower end of a respective one of the armature rings 147 or 247 and therefore free for self-centering self-aligning engagement with its seat 149 or 249. These features, together with the fact that the downstream well pressure is acting on these valves, provides positive assurance of bubble-tight closure of the three pressure equalizing valves. Also the presence of the air gap simulating spacer 147*a* or 247*a* avoids any possibility of the armatures 147 or 247 not promptly separating, due to residual magnetism, from pole piece 125 or 225 upon deenergization of the solenoid cell.

As will be recognized, any of a wide variety of conventional wire line servicing operations may be conducted through the tubing string to levels below cutoff valve assemblies 10, 10'. These operations are carried out while the cutoff valve is open thereby providing an unobstructed path axially of the tubing string with all portions of both the cutoff valve and the pressure equalizing valves and their seats completely shielded from possibility of damage by the wire line or any tools suspended thereon.

Although the two armatures and the flapper valve 36 in the first two embodiments have been shown as spring biased to respective positions it will be understood that, with the possible exception of the spring for the cutoff valve armature, no one of these springs is essential. This is because gravity and/or pressure differentials and/or the resistance offered to rapid flow conditions toward ground level may suffice to retract the armatures and to close the cutoff valve. For example, it will be noted that no springs are present in either of the pressure equalizing valves shown in FIGS. 7 and 8.

While the particular magnetically operated fail-safe cutoff valve with pressure equalizing means herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

We claim:

1. A magnetically operated valve assembly adapted to be opened by equalizing the pressure differential thereacross comprising:

a tubular housing adapted to be installed in tubing in communication with pressurized fluid at one end;

cutoff valve means supported crosswise of the interior of said housing movable to an open position providing a linear flow passage which is unobstructed from end to end of said valve assembly;

electric coil means coiled concentrically of said tubular housing;

tubular first armature means of magnetic material in axial alignment with said flow passage through said tubular housing, said armature means being reciprocably supported within said coil means and movable between the extended and retracted positions thereof and operable to open said cutoff valve means when the pressure thereacross is substantially equalized; and pressure equalizing valve means across small passage means having its opposite ends in communication with the opposite sides of said cutoff valve means and including second armature means of magnetic material positioned to be energized by said coil means and responsive thereto to open said pressure equalizing valve means and thereby effective to equalize the pressure differential across said cutoff valve means.

2. A magnetic valve assembly as defined in claim 1 characterized in that said second armature means comprises ring means encircling the fluid flow path through said tubular valve housing.

3. A magnetic valve assembly as defined in claim 2 characterized in that said pressure equalizing valve means includes a plurality of separate valves distributed about said ring means and each operatively associated with a separate flow passage means in communication with the opposite sides of said cutoff valve means.

4. A magnetic valve assembly as defined in claim 1 characterized in the provision of tubular pole piece means of magnetic material located in the flux circuit of said coil means and toward which said second armature means is attracted when said coil means is energized.

5. A magnetic valve assembly as defined in claim 1 characterized in the provision of a tubular pole piece of magnetic material located in the flux circuit of said coil means and toward which said first and second armatures are movable to open said pressure equalizing valve means and said cutoff valve means.

6. A magnetic valve assembly as defined in claim 5 characterized in that said tubular pole piece is positioned between said first and second armature means.

7. A magnetic valve assembly as defined in claim 1 characterized in that said tubular housing is securable in alignment with and as a part of a well tubing string, said valve assembly including a tubular pole piece extending coaxially of the interior of said housing opposite one end of said coil means and embracing the adjacent end of said first armature means, and said second armature means being supported adjacent the other end of said tubular pole piece and movable axially toward and away therefrom.

8. A magnetic valve assembly as defined in claim 7 characterized in that said tubular pole piece, said cutoff valve means, said first and second armature means and said pressure equalizing valve means are assembled to one another and adapted to be assembled within and removed as a unitary assembly from one end of said tubular housing.

9. A magnetic valve assemby as defined in claim 1 characterized in the provision of means normally biasing said first armature means to the extended position thereof and said cutoff valve means closed, and said pressure equalizing valve means and said cutoff valve means being operable upon the non or malfunctioning of said coil means to move to the closed positions thereof and said first armature means being movable to the exteneed position thereof.

10. A magnetic valve assembly as defined in claim 1 characterized in the provision of means for holding said pressure equalizing valve means in axial alignment for seating in a fluid tight manner in the closed position thereof.

11. A surface controlled magnetically operated fail-safe cutoff valve assembly equipped with magnetically operated pressure equalizing means comprising:

a tubular housing having an open-ended unobstructed linear flow passage axially thereof installable between the opposite ends of a tubing string;

cutoff valve means movably supported in said housing for movement between a closed position thereacross and an open position leaving said flow passage unobstructed and free for the passage of wireline supported devices therethrough;

tubular magnetic armature means supported axially within said housing and in said flow passage therethrough and biased to an extended position adjacent said cutoff valve means when the latter is closed;

magnetically controlled pressure equalizing valve means operable independently of said tubular armature means having flow connections with the opposite sides of said cutoff valve means; and solenoid coil means operable when energized to open said pressure equalizing valve means and said main cutoff means in sequence.

12. A safety cutoff valve assembly as defined in claim 11 characterized in the provision of tubular pole piece means in axial alignment with said linear flow passage and serving as a pole piece for both said armature means and said magnetically controlled pressure equalizing means.

13. A safety cutoff valve assembly as defined in claim 11 characterized in that said pressure equalizing valve means includes an armature ring of magnetic material lying in a diametric plane through said cutoff valve assembly.

14. A safety cutoff valve assembly as defined in claim 13 characterized in the provision of a chamber for said pressure equalizing valve means and said pressure equalizing valve means being free of contact with the walls of said chamber.

15. A safety cutoff valve assembly as defined in claim 14 characterized in that said equalizing valve means is mounted in an annular chamber embracing said linear flow passage.

16. A safety cutoff valve assembly as defined in claim 13 characterized in that said pressure equalizing valve means includes a plurality of valves each operatively associated with a respective fluid pressure equalizing passage by-passing said cutoff valve means and in communication with said linear flow passage through said cutoff valve assembly.

17. A safety cutoff valve assembly as defined in claim 12 characterized in that said tubular pole piece means is positioned between said tubular armature and said armature ring.

18. A safety cutoff valve assembly as defined in claim 12 characterized in that said pressure equalizing valve means is supported within an annular ring of non-magnetic material detachably coupled to one end of said tubular pole piece means.

19. A safety cutoff valve assembly as defined in claim 18 characterized in that said pressure equalizing valve means is positioned between the adjacent ends of said pole piece means and said ring of non-magnetic material.

20. A safety cutoff valve assembly as defined in claim 18 characterized in the provision of guide pin means and cooperating bores between said annular ring and said armature ring cooperable to restrict said armature ring substantially to movement axially thereof.

21. A safety cutoff valve assembly as defined in claim 12 characterized in that said cutoff valve means is mounted in said tubular pole piece means, and a ring of non-magnetic material detachably secured to the lower end of said pole piece means in a fluid tight manner and having an annular cavity for said armature ring.

22. A safety cutoff valve assembly as defined in claim 13 characterized in the provision of guide pin means and bores aligned therewith cooperating to restrict said armature ring means to movement axially thereof.

23. A safety cutoff valve assembly as defined in claim 11 characterized in that said assembly has threaded means at the opposite ends thereof for connecting said assembly between the opposite ends of a tubing string.

24. A safety cutoff valve assembly as defined in claim 11 characterized in that said tubular housing and all portions thereof except said solenoid coil means comprise a unitary assembly adapted to be detachably and operably mounted within and between the opposite ends of a tubing string.

25. A magnetic valve assembly as defined in claim 1 characterized in that said coil means and said first armature means are operable to open said cutoff valve means independently of a disabled condition of said pressure equalizing valve means when the pressure differential across the closed cutoff valve means is substantially equalized.

26. A magnetic valve assembly as defined in claim 1 characterized in that said small passage means in communication with the opposite sides of said cutoff valve means include at least one inlet passage and at least one outlet passage, and said outlet passage being of larger cross section than said inlet passage.

27. A magnetic valve assembly as defined in claim 26 characterized in that said pressure equalizing valve means is movable to an open position through a distance greater than the diameter of said inlet passage to freely pass particulate matter entering through said inlet passage.

28. A magnetic valve assembly as defined in claim 1 characterized in that said cutoff valve means includes means for closing the same as said first armature moves to the extended position thereof.

29. A magnetic valve assembly as defined in claim 28 characterized in that said means for closing said cutoff valve means includes spring means.

30. A magnetic valve assembly as defined in claim 1 characterized in that said first armature means includes spring means normally effective when said coil means is not energized to move and to hold said first armature means in the extended position thereof.

31. A magnetic valve assembly as defined in claim 1 characterized in that said second armature is positioned and operable to close said pressure equalizing valve means upon deenergization of said coil means.

32. A safety cutoff valve assembly as defined in claim 11 characterized in the provision of means for biasing said tubular armature means toward the extended position thereof.

33. A safety cutoff valve assembly as defined in claim 11 characterized in the provision of spring means biasing said cutoff valve means toward the closed position thereof and effective to close the same as said tubular armature means moves to the extended position thereof.

34. A magnetic valve assembly as defined in claim 1 characterized in that said pressure equalizing valve means includes spring means biasing the same to the closed position thereof.

35. A safety cutoff valve as defined in claim 11 characterized in that said first armature means includes spring means biasing the same toward the extended position thereof.

36. A safety cutoff valve as defined in claim 11 characterized in the provision of spring means operable to bias said pressure equalizing valve means toward the closed position thereof.

37. A magnetic valve assembly as defined in claim 1 characterized in the provision of a separate tubular pole piece of magnetic material operatively associated with a respective one of said first and second armature means and separated from one another by a ring of non-magnetic material.

38. A magnetic valve assembly as defined in claim 37 characterized in that said electric coil means is formed in first and second sections operatively associated with a respective one of said first and second armature means.

39. A magnetically operated valve assembly as defined in claim 1 characterized in that said cutoff valve means is selectively operable to open position thereof by said pressure equalizing valve means and alternatively by increasing the pressure on the outlet side thereof to a value approaching or exceeding the pressure on the inlet side thereof.

40. A magnetic valve assembly as defined in claim 1 characterized in that said pressure equalizing valve means is constructed and arranged to close automatically upon power failure to said solenoid coil means.

41. A magnetically operated safety cutoff valve assembly comprising:

a tubular housing adapted to be installed in tubing having one end in communication with pressurized fluid;

normally closed first valve means controlling flow through said housing and movable to an open position providing an unobstructed linear flow pasage from end-to-end of said housing;

solenoid coil means embracing said flow passage;

normally closed second valve means controlling fluid flow between the opposite sides of said first valve means and operable, when open, to equalize the pressure on the opposite sides of said first valve means;

first and second independently movable armature means positioned for actuation by said solenoid coil means and operatively associated with a respective one of said first and second valve means; and said solenoid coil means being operable when energized to open said second valve means and thereafter to open said first valve means when the pressure differential thereacross has been substantially equalized.

42. A safety cutoff valve assembly as defined in claim 41 characterized in the provision of spring means for biasing said first armature means to the retracted position thereof when said solenoid coil means is not energized.

43. A safety cutoff valve assembly as defined in claim 41 characterized in the provision of pole piece means of magnetic material outside said linear flow passage, said pole piece means being positioned between and spaced from said first and second armature means when said solenoid coil means is deenergized.

44. A safety cutoff valve assembly as defined in claim 43 characterized in that said first and second armature means are positioned adjacent a respective one of said pole piece means.

45. A safety cutoff valve assembly as defined in claim 41 characterized in that said first and second armature means are annular and embrace said linear flow passage.

46. A safety cutoff valve assembly as defined in claim 43 characterized in that said pole piece means is annular and embraces said linear flow passage.

47. A safety cutoff valve assembly as defined in claim 41 characterized in that said first valve means comprises a flapper valve pivotally supported along one side of said linear flow passage and spring biased to the closed position thereof.

48. A safety cutoff valve assembly as defined in claim 47 characterized in that said first armature means includes means arranged to engage said first valve means and open the same as said first armature means is moved to the retracted position thereof by said solenoid coil means.

49. A safety cutoff valve assembly as defined in claim 48 characterized in that said means engageable with said first valve means to open the same is positioned to substantially isolate said first valve means from the fluid flow stream therepast while said first valve means is open.

50. A safety cutoff valve assembly as defined in claim 41 characterized in that said housing is provided with an annular chamber for said second armature means and said second valve means and including passage means connecting said second valve means to the opposite sides of said first valve means.

51. A safety cutoff valve assembly as defined in claim 50 characterized in that said second valve means and said second armature means comprises a unitary assembly.

52. A safety cutoff valve assembly as defined in claim 41 characterized in that said first armature means is tubular and forms the major portion of said unobstructed linear flow passage through said valve assembly when said first valve means is open.

53. A safety cutoff valve assembly as defined in claim 52 characterized in that, in the open position of said first valve means, said unobstructed fluid flow passage extends substantially from end-to-end of said valve assembly and is sufficiently large to accommodate wireline service operations therethrough and beyond said open first valve means.

54. A safety cutoff valve assembly installable between the opposite ends of a tubing string comprising:

an open-ended tubular main body;

normally closed cutoff valve means in said main body movable to an open position providing an unobstructed linear flow path from end-to-end thereof;

said main body including a first ring of magnetic material and a second ring of non-magnetic material surrounding said linear flow path and shaped to provide an annular valve chamber therebetween and including at least one set of inlet and outlet flow channels between said chamber and the opposite sides of said cutoff valve means;

self-centering self-aligning valve means normally seated on valve seat in the outlet one of said at least one set of flow channels;

an annular armature in said valve chamber having limited freedom of movement in all directions relative to the walls of said chamber and operatively connected to said valve means; and solenoid means embracing said valve chamber and effective when energized to move said armature against said first ring and open said valve means to equalize the pressure across said cutoff valve means.

55. A safety cutoff valve assembly as defined in claim 54 characterized in that said valve chamber is in communication with said linear flow path through said cutoff valve assembly solely via said inlet and outlet flow channels.

56. A safety cutoff valve assembly as defined in claim 54 characterized in that said first and second rings together with said cutoff valve means are detachable as a unit from the downstream end of said tubular main body.

57. A safety cutoff valve assembly as defined in claim 54 characterized in the provision of three sets of said inlet and outlet flow channels each controlled by a respectively self-centering self-aligning valve means and a seat for a respective one thereof.

58. A safety cutoff valve assembly as defined in claim 57 characterized in that said self-centering self-aligning valve means are loosely supported on said armature with limited freedom to move relative thereto.

59. A cutoff valve assembly as defined in claim 54 characterized in that said armature is provided with non-magnetic spacer means on the end thereof nearest an end of said first ring to facilitate separation of said armature from said first ring when said solenoid is deenergized.

60. A cutoff valve assembly as defined in claim 54 characterized in that said valve means are conical with the apex end thereof positioned to close against a respective seat of said outlet flow channels discharging into the downstream side of said cutoff valve means.

61. A cutoff valve assembly as defined in claim 54 characterized in the provision of a plurality of aligning pins and a plurality of cooperating walls operatively associated with said armature and with one of said first and second rings for maintaining said valve means in general axial alignment with the adjacent one of said valve seats while said valve means are open.

62. A fail-safe cutoff valve assembly equipped with magnetically operated pressure equalizing means comprising:

a tubular housing having an open-ended unobstructed linear flow passage axially thereof installable between the opposite ends of a tubing string;

cutoff valve means movably supported in said housing for movement between a closed position thereacross and an open position leaving said linear flow passage unobstructed and free for the passage of wireline supported devices therethrough;

means supported within said housing for opening and closing said cutoff valve means and including means biased to a position adjacent said cutoff valve means when the latter is closed;

magnetically controlled pressure equalizing valve means operable independently of said means for opening said cutoff valve means and controlling flow through passages in communication with the opposite sides of said cutoff valve means;

solenoid coil means operable when energized to open said pressure equalizing valve means; and means for activating said means for opening and closing said cutoff valve means when the pressure thereacross is substantially equalized.

63. A cutoff valve assembly as defined in claim 62 characterized in that said pressure equalizing valve means includes a plurality of self-centering self-aligning valves and valve seats in a respective one of said flow connections between the opposite sides of said cutoff valve means.

64. A cutoff valve assembly as defined in claim 63 characterized in that said pressure equalizing valve means includes an armature ring surrounding said linear flow passage and embraced by said solenoid coil means; and said self-centering self-aligning valves being operatively associated with said armature ring.

65. A cutoff valve assembly as defined in claim 64 characterized in the provision of an annular chamber for said armature ring, and said ring having limited freedom of movement relative to the walls of each chamber.

66. A cutoff valve assembly as defined in claim 63 characterized in that said valve seats are located on the downstream side of said self-centering self-aligning valves.

* * * * *